US008794785B2

(12) United States Patent
Campbell

(10) Patent No.: US 8,794,785 B2
(45) **Date of Patent: *Aug. 5, 2014**

(54) ILLUMINATED SPORTS BOARD

(75) Inventor: Christopher Campbell, San Diego, CA (US)

(73) Assignee: Photon Light Boards, Inc, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/275,287

(22) Filed: Oct. 17, 2011

(65) Prior Publication Data

US 2012/0140510 A1 Jun. 7, 2012

Related U.S. Application Data

(62) Division of application No. 12/287,060, filed on Oct. 2, 2008, now Pat. No. 8,038,313.

(60) Provisional application No. 60/997,391, filed on Oct. 2, 2007.

(51) Int. Cl.
*F21V 33/00* (2006.01)

(52) U.S. Cl.
USPC ..... 362/183; 362/486; 362/234; 362/800

(58) Field of Classification Search
USPC ..... 362/183, 496, 234, 800
See application file for complete search history.

(56) References Cited

U.S. PATENT DOCUMENTS 4,991,066 A * 2/1991 McCowan ..... 362/464
4,997,196 A * 3/1991 Wood ..... 280/87.042
6,802,636 B1 * 10/2004 Bailey, Jr. ..... 362/555

* cited by examiner

*Primary Examiner* — Laura Tso
(74) *Attorney, Agent, or Firm* — Gary L. Eastman, Esq.

(57) ABSTRACT

The present invention includes a skate board having a deck, a pair of trucks mounted beneath the deck and equipped with wheels. The deck is equipped with a plurality of light emitting devices, such as LEDs, which are mounted to the deck in a distinct pattern. The LEDs are in electrical connection with an energy source, such as a rechargeable battery. In a preferred embodiment, the rechargeable battery is mounted into the deck in a removable pack which can be charged without removing it from the deck. A microcontroller may be incorporated which provides for the selective illumination of the light emitting devices, and which may pulse, flicker, or create other aesthetically pleasing illumination patterns.

9 Claims, 10 Drawing Sheets

282
290
Motion sensor
292
280
294
284

296
Micro Controller
memory
Input Data
Charge
295
298
286
300
312
302
304
306
308
310

ILLUMINATED SPORTS BOARD

RELATED APPLICATIONS

This is a divisional of U.S. patent application Ser. No. 12/287,060, filed Oct. 2, 2008 now U.S. Pat. No. 8,038,313, which claims the benefit of priority to U.S. Provisional Patent Application No. 60/997,391 entitled "Illuminated Sports Board" filed Oct. 2, 2007, and currently co-pending.

FIELD OF THE INVENTION

The present invention relates generally to devices used in outdoor athletic activities. The present invention is more particularly, though not exclusively, useful as a skateboard having unique illumination characteristics.

BACKGROUND OF THE INVENTION

Skateboards have been around for years. In the 1970, the skateboard became a staple in nearly all children's outdoor activities. While the popularity of the skateboard has ebbed and flowed over the decades, the technology for the skateboard and its components has continued to improve. It is not uncommon today to have a skateboard made from sophisticated composite materials and equipped with state-of-the-art wheels, bearings, and trucks.

In efforts to provide product brand identity and uniqueness within the skateboard industry, various skateboard manufacturers have incorporated colorful and artistic images on the upper surface and lower surface of the deck. While these images are indeed aesthetically pleasing, they are rather ordinary when comparing boards manufactured by various manufacturers. In fact, in some cases, the only distinction between various skateboard manufacturers is the proprietary artwork or logo.

In light of the above, it would be advantageous to provide a skateboard with a unique, customizable appearance. It would also be advantageous to provide individual skateboarders with the ability to visibly stand out in the crowd of skaters.

SUMMARY OF THE INVENTION

The present invention includes a skate board having a deck, a pair of trucks mounted beneath the deck and equipped with wheels. The deck is equipped with a plurality of light emitting devices, such as LEDs, which are mounted to the deck in a distinct pattern. The LEDs are in electrical connection with an energy source, such as a rechargeable battery. In a preferred embodiment, the rechargeable battery is mounted into the deck in a removable pack which can be charged without removing it from the deck. A microcontroller may be incorporated which provides for the selective illumination of the light emitting devices, and which may pulse, flicker, or create other aesthetically pleasing illumination patterns.

Various objects, features, aspects and advantages of the present invention will become more apparent from the following detailed description of preferred embodiments of the invention, along with the accompanying drawings.

DETAILED DESCRIPTION

Figure 1:
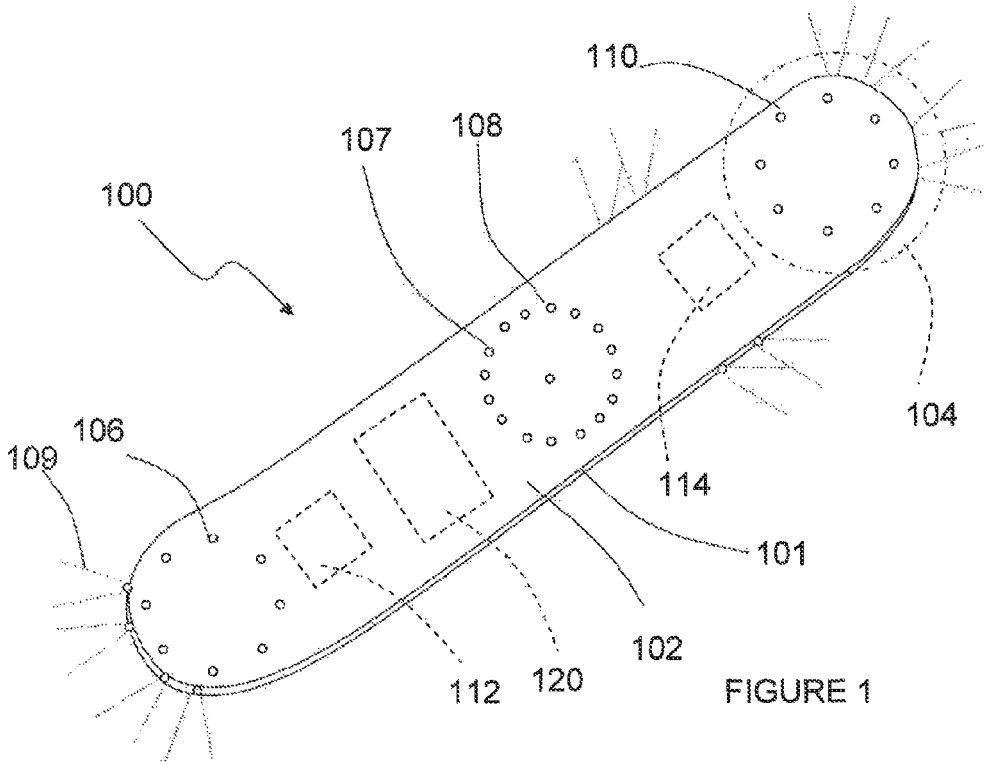
FIG. 1 is a perspective view of the illuminated sports board of the present invention showing an exemplary light emitting device pattern, and shows (using dashed lines) the general illumination pattern extending from the board.

Referring initially to FIG. 1, a perspective view of the illuminated sports board of the present invention is shown and generally designated 100. Board 100 includes a deck 102 having a variety of light emitting devices (shown generally using dashed lines) 104 106 and 108. It is to be appreciated that the specific pattern of light emitting devices is merely exemplary of a preferred embodiment, and the specific number, placement, orientation and color of the light emitting devices can vary without departing from the present invention. Dashed lines 109 are shown to represent the light pattern leaving the light emitting device from the sides of the board; however, it is also to be appreciated that the light emitting devices shown in the deck and not adjacent the side 101, such as light emitting device 107, can be seen from the upper and lower surfaces of the deck 102.

Trucks (not shown) are mounted to the underside of the illuminated sports board 100, and the relative location is shown with dashed lines 112 and 114. It is to be appreciated, however, that the precise location and size relative to the deck 102 may differ.

Figure 2:
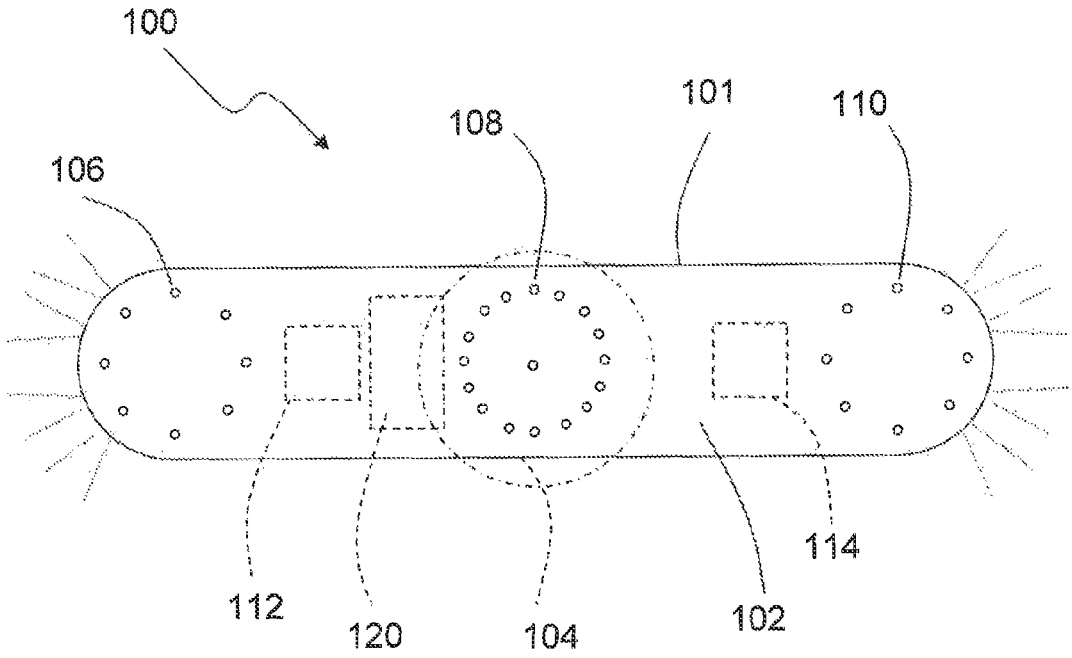
FIG. 2 is atop plan view of the illuminated sports board of the present invention showing the board of FIG. 1 and the relative placement of the light emitting devices.

Referring to FIG. 2, a top plan view of the illuminated sports board 100 of the present invention is shown. From this view, the location of the battery pack 120 is generally shown by dashed lines. The location of the battery pack is intentionally distinct from the location of the truck as the battery pack is fully accessible without having to remove or disturb the truck assemblies in any way.

Figure 3:
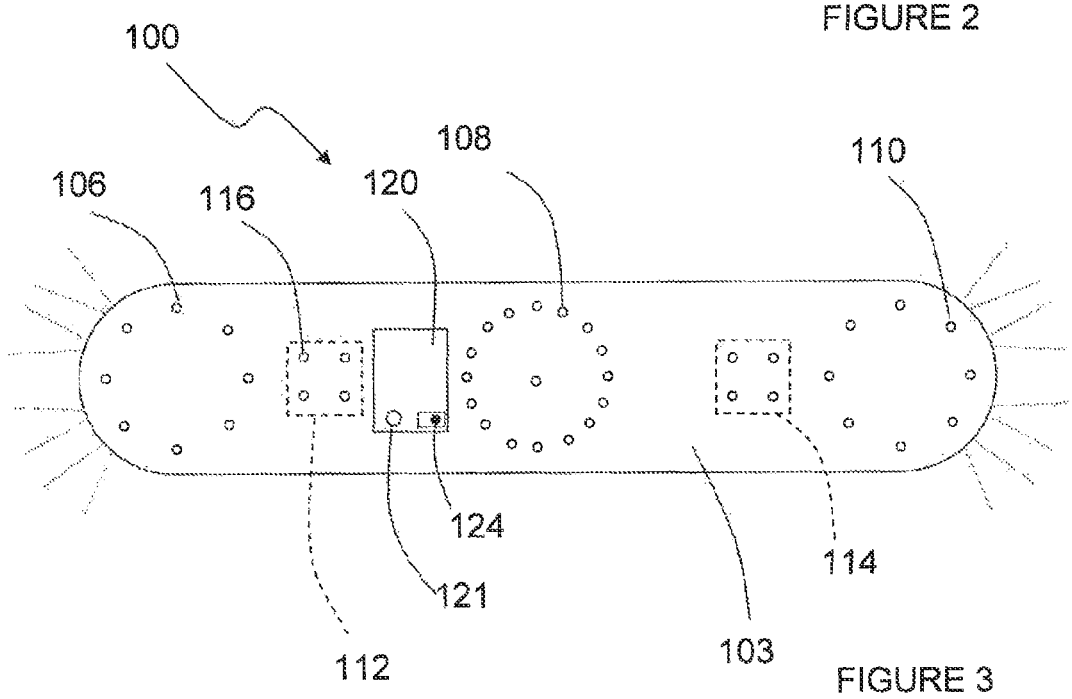
FIG. 3 is a bottom plan view of the illuminated sports board of the present invention showing the placement of the trucks (in dashed lines) and the battery pack having a charging port, and an ON/OFF switch.

FIG. 3 shows a bottom plan view of the illuminated sports board 100 of the present invention. Removable battery pack 120 is shown to have a charging port 121 and an ON/OFF switch 124. From this figure, the location of battery pack 120 is clearly distanced from truck mounting locations 112 and 114.

Figure 4:
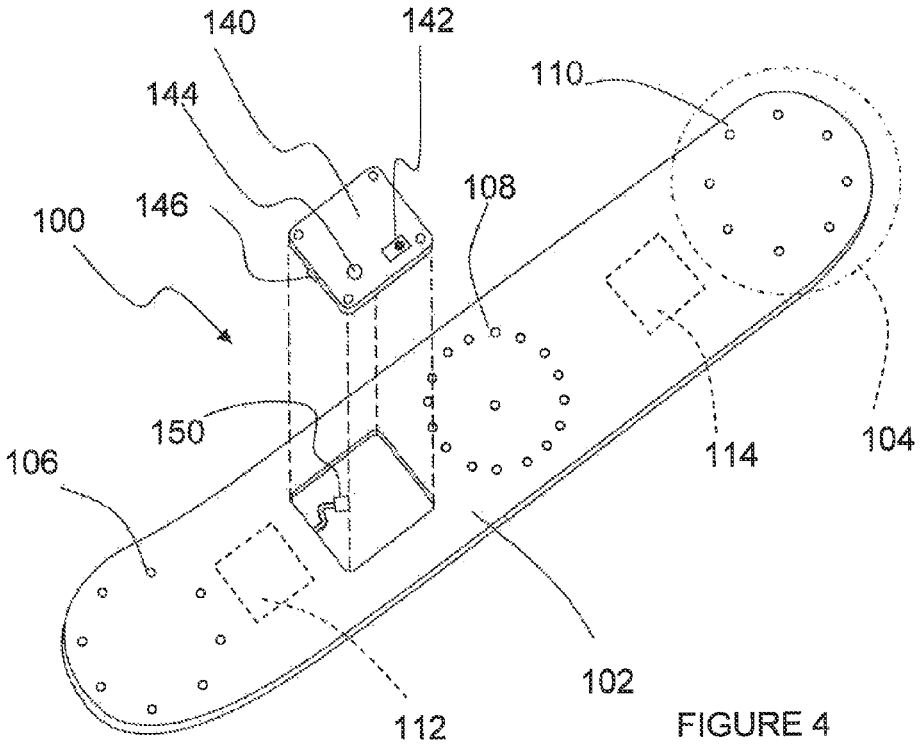
FIG. 4 is a perspective view of an alternative embodiment of the illuminated sports board of the present invention showing a removable battery pack having an electrical connection which can be disconnected from the battery pack.

FIG. 4 is a perspective view of an alternative embodiment of the illuminated sports board 100 of the present invention showing a removable battery pack 140 having an ON/OFF switch 142 and a recharge port 144. An electrical connection 146 is provided which can be connected and removed disconnected from a wiring connector 150 which provides further electrical connection to the various light emitting devices 104, 106, and 108. In a preferred embodiment, the battery pack 140 will include a nickel-metal-hydride (NiMH), lithium hydride (LiH), or other battery state-of-the-art chemical composition having a high charge density and capable of many charge/recharge cycles, as is known in the industry.

By utilizing a modular battery pack 140, it is possible to provide multiple batter packs for a single board 102. In fact, if a skating enthusiast will be using his or her board for an extended period of time, he or she could charge several battery packs 140 and replace them as they become discharged.

Figure 5:
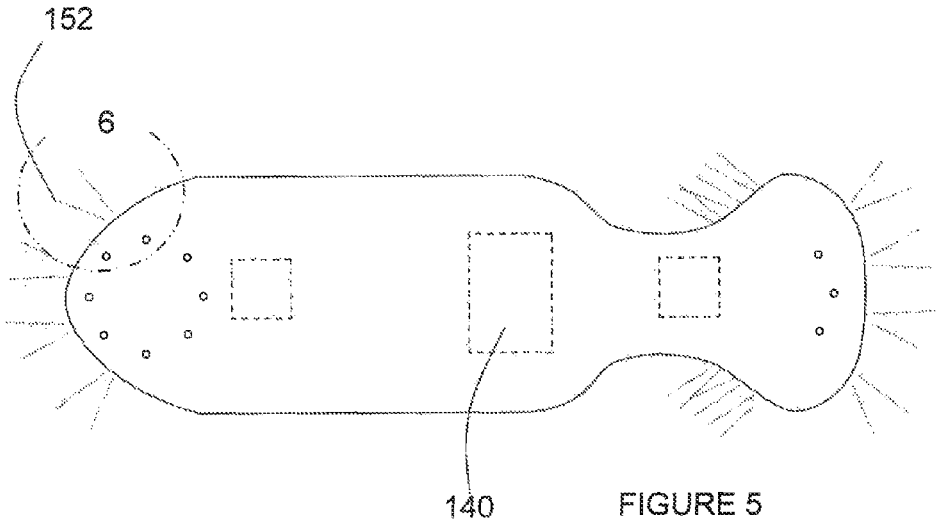
FIG. 5 is a top plan view of an alternative embodiment of the illuminated sports board of the present invention showing a distinct shape and a different light emitting device pattern with light emitting devices pointing forward, backwards, and forward at an angle.

Referring now to FIG. 5, a top plan view of an alternative embodiment of the illuminated sports board of the present invention is shown and generally designated 150. Board 150 includes a battery pack 140 and a number of recessed lights (not shown this Figure) which produce a light pattern 152 (shown in dashed lines). Board 150 has a distinct shape and a different light emitting device pattern than other embodiments shown herein, with light emitting devices pointing forward, backwards, and forward at an angle.

Figure 6:
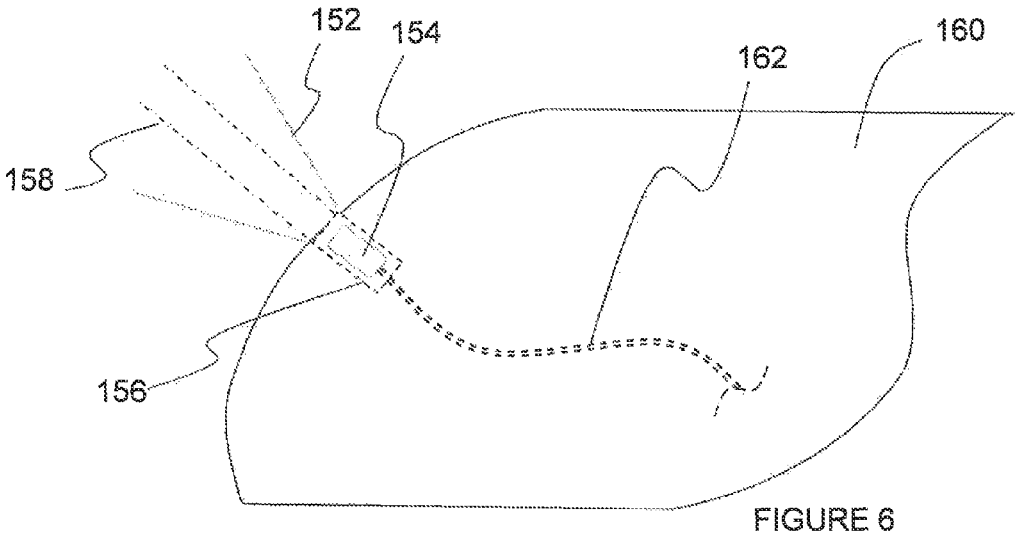
FIG. 6 is a close-up view of detail 6 of the illuminated sports board of the present invention shown in FIG. 5, and shows the placement of a light emitting device within a bore formed in the deck and having an electrical connection.
Figure 7:
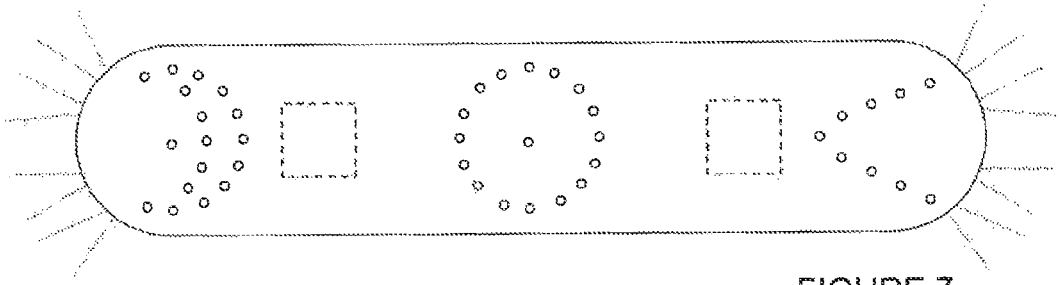
FIGS. 7 through 13 are alternative embodiments of the illuminated sports board of the present invention showing various light emitting device patters in combination with various board shapes.
Figure 8:
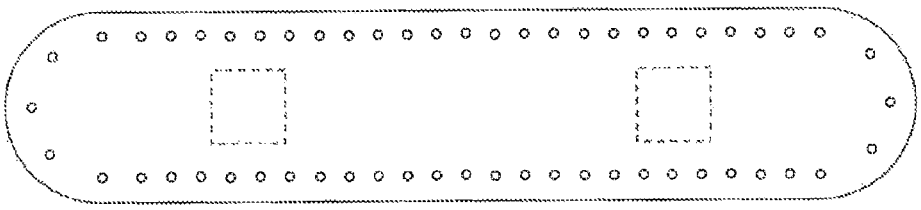
Figure 9:
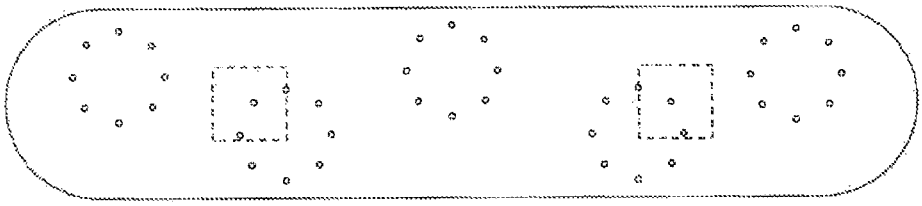
Figure 10:
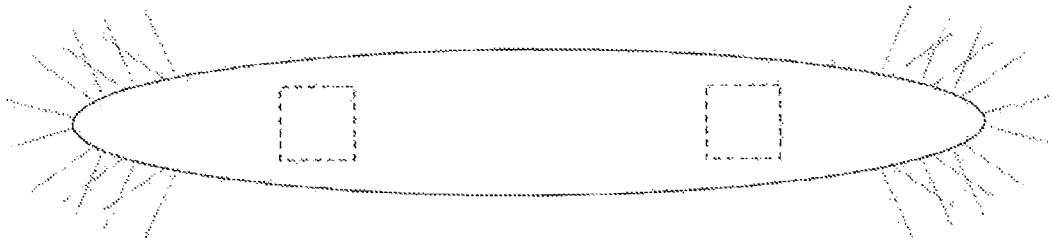
Figure 11:
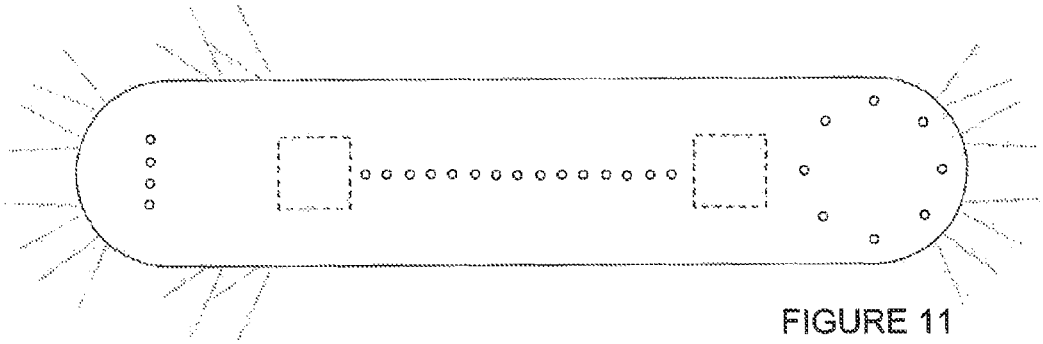
Figure 12:
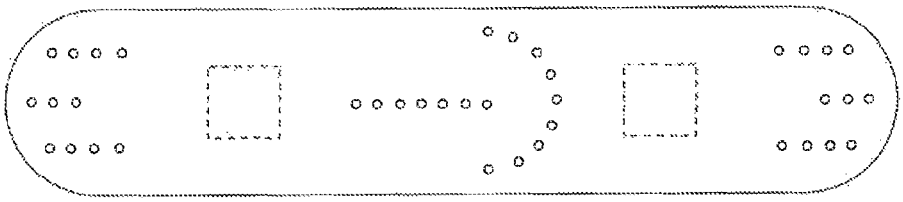
Figure 13:
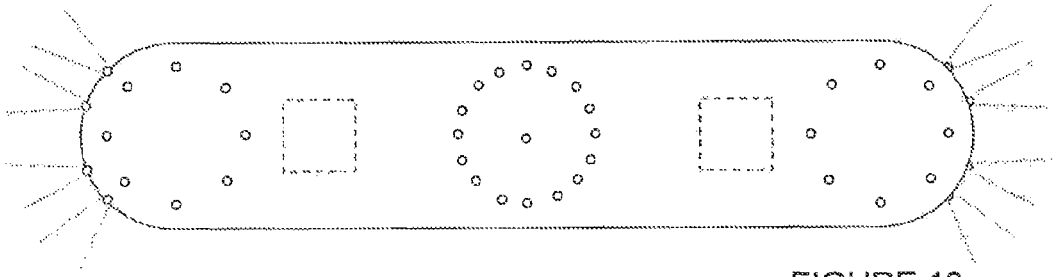

A close up of detail 6 of the illuminated sports board of the present invention 150 shown in FIG. 5, is shown in FIG. 6, and shows the placement of a light emitting device 154 within a bore 156 formed in the deck 160. As shown, light emitting device 154 is in electrical connection with wiring 162 which leads off to other light emitting devices 154, and battery pack (not shown this Figure). Light emitting device 154 may be secured within bore 156 using a substantially translucent epoxy or adhesive in order to securely mount the device 154, while not obscuring the transmission of light therefrom.

FIGS. 7 through 13 are alternative embodiments of the illuminated sports board of the present invention showing various light emitting device patters in combination with various board shapes. While a few different shapes have been shown herein to represent exemplary deck shapes, such shapes are merely exemplary of preferred embodiments. It is to be understood that no limitation whatsoever is intended by these figures, and that they are merely indicative of the variety and versatility of the present invention.

Figure 14:
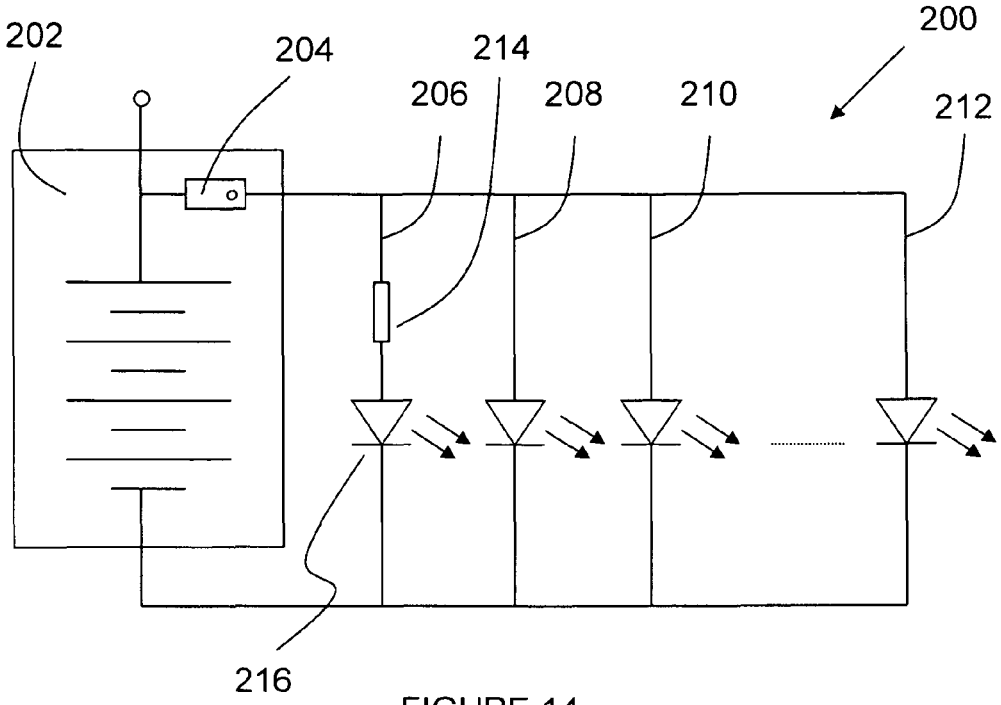
FIG. 14 is a schematic representation of the circuitry of the illuminated sports board of the present invention showing a battery, and several light emitting device circuits, and incorporating current limiting resistors and/or capacitors.

FIG. 14 is a schematic representation of the circuitry of the illuminated sports board of the present invention showing a battery, and is generally identified as circuit 200. Circuit 200 includes a battery 202 having an ON/OFF switch 204 which leads to one or more parallel circuits 206, 208, 210, and 212. A current limiting resistor 214 may be provided which allows for a higher voltage battery 202 to be used with a lower voltage rated light emitting diode 216.

Figure 15:
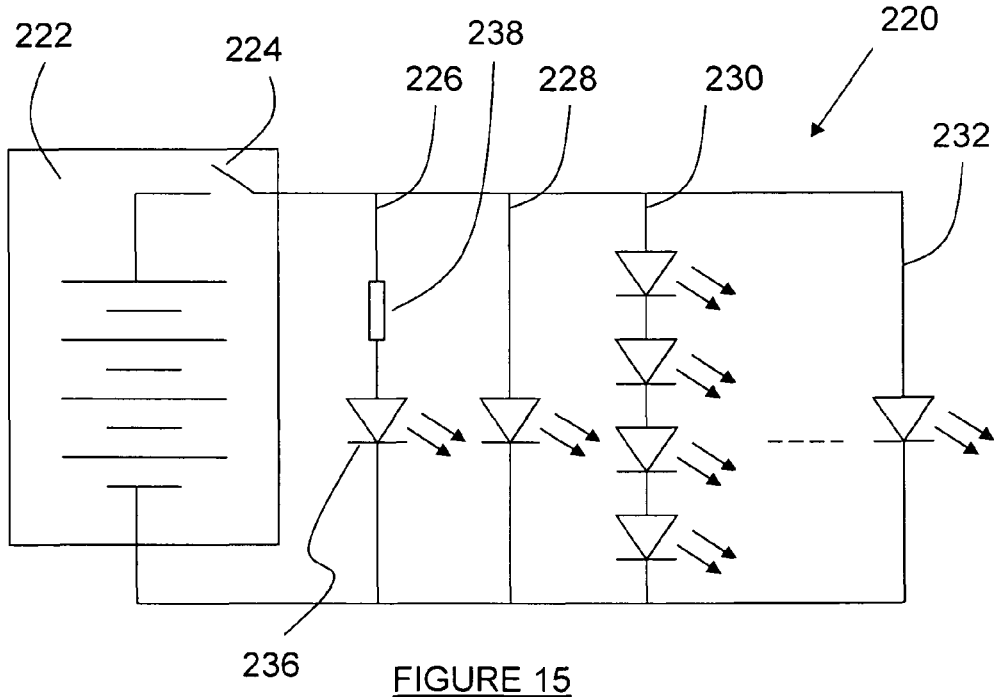
FIG. 15 is a schematic representation of an alternative embodiment of the circuitry for the illuminated sports board of the present invention showing a battery, and several light emitting device circuits with each circuit having a varying number of light emitting devices thereby providing varying levels of illumination, and/or incorporating light emitting devices having different electrical or optical characteristics.

Referring to FIG. 15, a schematic representation of an alternative embodiment of the circuitry for the illuminated sports board of the present invention is generally designated 220. Circuit 220 includes a battery 222 with an ON/OFF switch 224, and several light emitting device circuits 226, 228, 230, and 232, with each circuit having a varying number of light emitting devices 236 thereby providing varying levels of illumination, and/or incorporating light emitting devices having different electrical or optical characteristics. A current limiting device, such as a resistor 238, may be incorporated into circuits in order to limit the current through a particular light emitting device 236. For example, in some applications, it may be desirable to have brighter light emitting devices in some areas of the deck, and dimmer light emitting devices in other areas of the deck. By selectively incorporating various current or voltage limiting components 238, differing brightness levels may be achieved.

Figure 16:
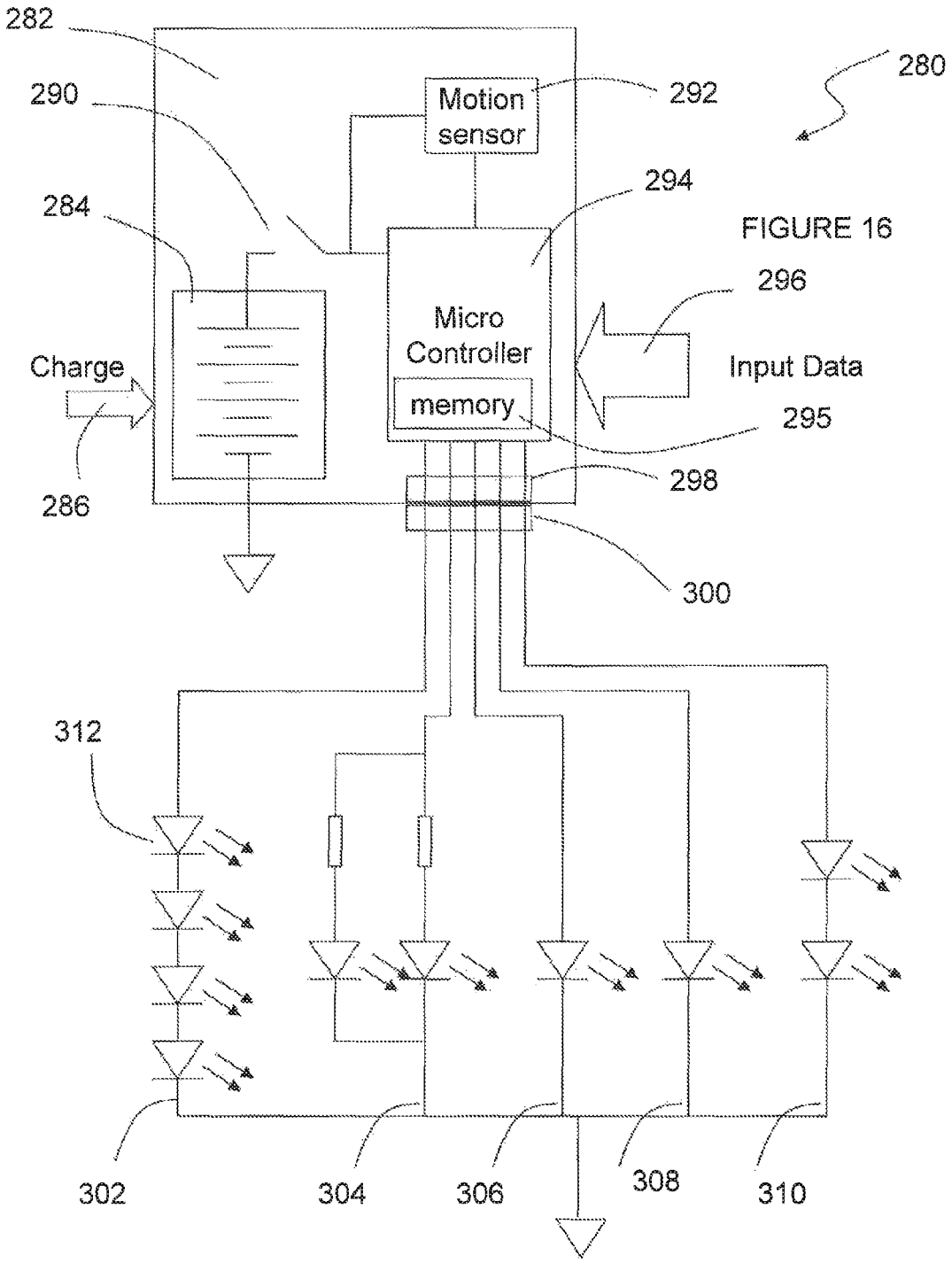
FIG. 16 is a schematic representation of an alternative embodiment of the circuitry for the illuminated sports board of the present invention showing a rechargeable battery, a microcontroller, and a motion sensor, which in combination provide electrical signals to multiple light emitting device circuits.

Referring now to FIG. 16, a schematic representation of an alternative embodiment of the circuitry for the illuminated sports board of the present invention is generally designated 280. Circuit 280 includes a control module 282 having a battery 284 provided with a charging port 286. An ON/OFF switch 290 controls the flow of power to a motion sensor 292 and a microcontroller 294.

Microcontroller 294 is preloaded with a series of control schemes in memory 295 for selectively illuminating one or more light emitting devices. Additionally, control module 282 may be equipped with an input data port 295 which may provide for the programming, or re-programming of microcontroller 294. An electrical connector 298 is provided on module 282 which corresponds to connector 300. The combination of motion sensor 292, microcontroller 294 and memory 295 provides for varying electrical signals through connector 3298 and 300 to multiple light emitting device circuits.

Circuit 280 includes a number of light emitting device circuits 302, 304, 306, 308 and 310. As shown, the light emitting devices 312 may be in series such as in circuit 302, or may be in parallel such as in circuit 304. These circuit types may be combined to provide for varying illumination techniques and effects.

Figure 17:
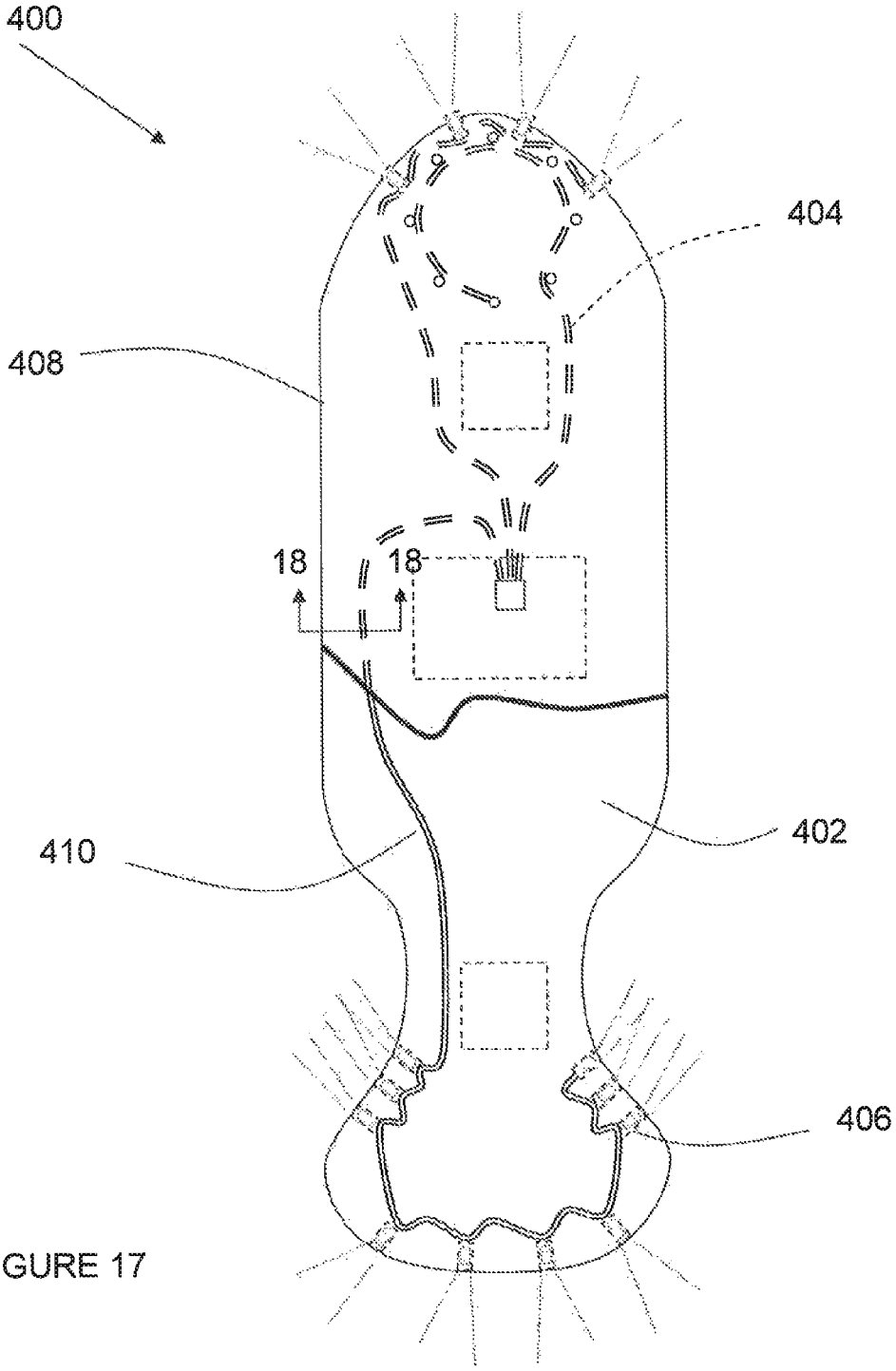
FIG. 17 is an exemplary illuminated sports board of the present invention showing a three separate representative circuits extending from a connector and between the different light emitting devices, and with a portion covered with a high-friction tape, such as is known as "grip-tape" to cover the wiring.

Referring now to FIG. 17, an exemplary illuminated sports board of the present invention is generally designated 400. In this embodiment, board 400 includes a deck 402 containing a wiring harness 404 which leads, through different circuit branches, to multiple light emitting devices 406. As shown from this Figure, wiring harness 404 extends from light emitting source to light emitting source to establish an electrical connection therewith.

Deck 402 may be covered with a high friction surface, such as grip tape 408, which provides a non-skid surface on the upper side of the deck 402. In a preferred embodiment, grip tape 408 covers wiring harness 404 to avoid damage to the wiring and to cover and seal the channels formed in the deck to receive the wiring harness (shown in FIG. 18). From this view with grip tape 408 partially removed, wiring 410 is visible on deck 402, while wiring 404 is shown in phantom representing that it is beneath the grip tape.

From this view, it is apparent that there are three separate representative circuits extending from the connector and between the different light emitting devices.

Figure 18:
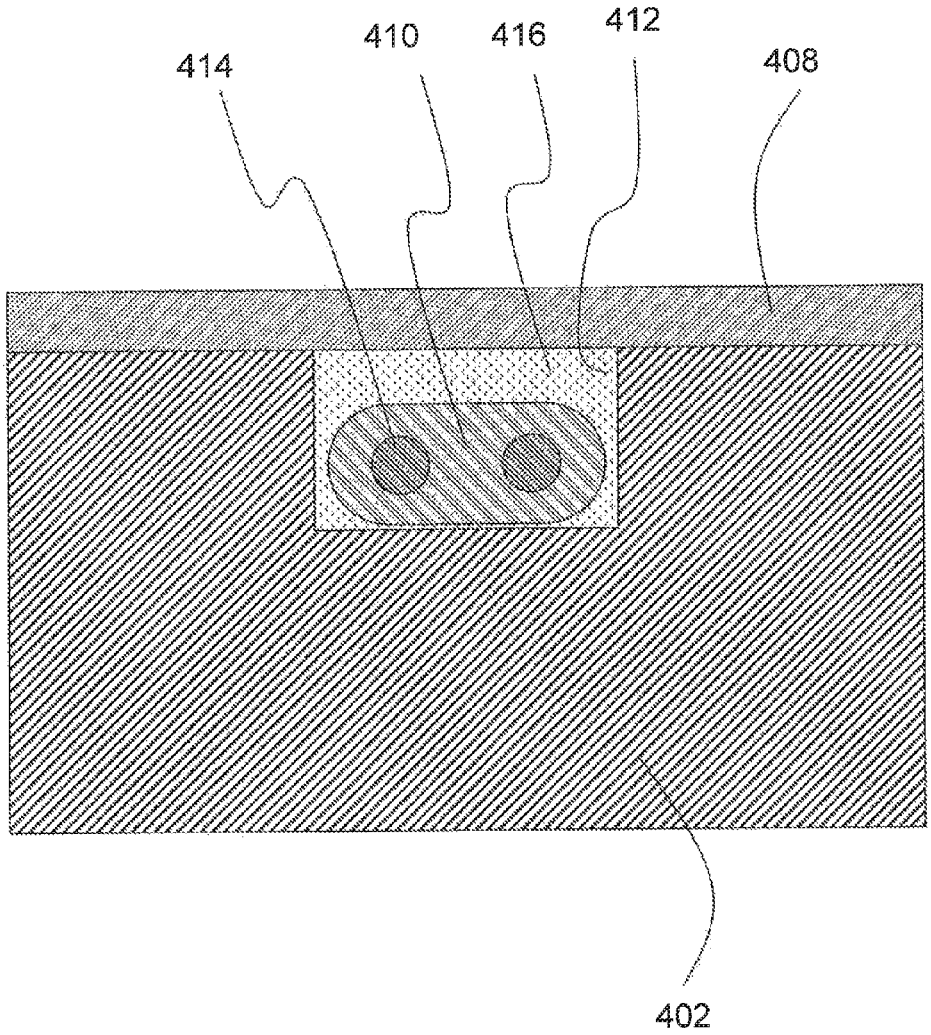
FIG. 18 is a cross-sectional view of the illuminated sports board of the present invention showing the deck formed with a trench sized to receive a two-conductor wire, and secured in place with potting material, such as epoxy, and sealed with a grip tape.

A cross section of board 400 is shown in FIG. 18, as taken along cross-section 18-18 of FIG. 17. From this view, the deck 402 of the illuminated sports board 400 of the present invention is shown to be formed with a trench 412 sized to receive a multi-conductor wire 410, and secured in place with potting material 416, such as epoxy.

Wire 410 may be a multi conductor cable having two or more conductors 414. It is to be appreciated that wire 410 may have multiple conductors establishing multiple electrical connections with various light emitting devices in order to provide for selective illumination effects, such as blinking, strobing around the perimeter of the board, sequentially through multiple light emitting devices, etc.

Once wire 410 is placed in trench 412 and sealed with potting 416, a grip tape 408 is placed on deck 402. This tape 408 provides isolation from environmental conditions (e.g. moisture, puddles, rain, etc.), as well as provides for a skid-free surface for safely riding the board 400.

While the illuminated sports board of the present invention described herein has been described as a skate board, it is to be appreciated that other sports boards are fully contemplated herein. For instance, by way of explanation and not exclusion, the present invention includes snow boards, surf boards, skate boards, skates, skis, water skis, wake boards, and the like.

The light emitting devices described herein are inclusive of light emitting diodes (LED), light bulbs, incandescent light bulbs, fluorescent light bulbs, and any other light emitting device known in the industry.

I claim:

1. An illuminated sports board, comprising:

a deck;

a plurality of light emitting devices embedded into a surface of said deck;

a removable and rechargeable power supply embedded into said surface of said deck;

a pair of trucks mounted beneath the deck; and a pair of wheels attached to each said truck.

2. The illuminated sports board, of claim 1, wherein said plurality of light emitting devices connected with an energy source and said light emitting devices are selected from the group consisting of light emitting diodes (LED), light bulbs, incandescent light bulbs, and fluorescent light bulbs.

3. The illuminated sports board, of claim 1, wherein said plurality of light emitting devices further comprise a micro-controller that may be incorporated for selective illumination.

4. The illuminated sports board, of claim 1, wherein said light emitting devices incorporated into the circuit comprising:

varying levels of illumination; and different electrical or optical characteristics.

5. The illuminated sports board, of claim 1, wherein said light emitting devices are secured using a translucent epoxy or adhesive in order to be securely mounted.

6. The illuminated sports board of claim 1, wherein said removable and rechargeable pack of power supply is utilized in a modular form providing multiple battery packs for a single board, for an extended period of time of use.

7. The illuminated sports board of claim 1, wherein said deck is formed with a trench sized to receive a two-conductor wire, and secured in place with potting material and sealed.

8. The illuminated sports board of claim 1, wherein said deck includes a wiring harness which leads to multiple light emitting devices.

9. The illuminated sports board of claim 1, wherein said deck is covered with a high friction surface.

* * * * *